US011667363B2

(12) United States Patent
Liu et al.

(10) Patent No.: US 11,667,363 B2
(45) Date of Patent: Jun. 6, 2023

(54) UNDERWATER ROBOT BASED ON VARIABLE-SIZE AUXILIARY DRIVE AND CONTROL METHOD THEREOF

(71) Applicant: Guangzhou University, Guangzhou (CN)

(72) Inventors: Airong Liu, Guangzhou (CN); Jiaqiao Liang, Guangzhou (CN); Junda Chen, Guangzhou (CN); Jiyang Fu, Guangzhou (CN); Bingcong Chen, Guangzhou (CN)

(73) Assignee: GUANGZHOU UNIVERSITY, Guangzhou (CN)

( * ) Notice: Subject to any disclaimer, the term of this patent is extended or adjusted under 35 U.S.C. 154(b) by 0 days.

(21) Appl. No.: 17/750,739

(22) Filed: May 23, 2022

(65) Prior Publication Data

US 2023/0103110 A1 Mar. 30, 2023

(30) Foreign Application Priority Data

Sep. 24, 2021 (CN) ..... 202111119100.2

(51) Int. Cl.
*B63G 8/00* (2006.01)
*B63G 8/24* (2006.01)

(52) U.S. Cl.
CPC ..... *B63G 8/001* (2013.01); *B63G 8/24* (2013.01); *B63G 2008/002* (2013.01)

(58) Field of Classification Search
CPC . B63G 8/00; B63G 8/001; B63G 8/24; B63G 8/39
USPC ..... 114/312
See application file for complete search history.

(56) References Cited

U.S. PATENT DOCUMENTS 9,254,899 B2 * 2/2016 Sparks ..... B63G 8/001

FOREIGN PATENT DOCUMENTS

CN 111252223 A * 6/2020 ..... B63G 8/24
WO WO-2020177037 A1 * 9/2020 ..... B63G 8/24

* cited by examiner

*Primary Examiner* — Lars A Olson
(74) *Attorney, Agent, or Firm* — Getech Law LLC; Jun Ye

(57) ABSTRACT

An underwater robot based on a variable-size auxiliary drive and a control method thereof includes a variable-size auxiliary drive module and a main control system. The variable-size auxiliary drive module includes a first variable-size silo, at least two first variable-size units and at least two first gasbags. The first variable-size silo has a first accommodating space with at least two first accommodating subspaces. Each of the first variable-size units includes a first micro push rod motor, a first push rod, a first push plate and a first gas guide tube. The first micro push rod motor, the first push rod and the first push plate are accommodated in the corresponding first accommodating subspace. The first push rod is fixed to the first push plate. one of the first gas guide tubes correspondingly communicates with one of the first accommodating subspaces and one of the first gasbags.

6 Claims, 3 Drawing Sheets

UNDERWATER ROBOT BASED ON VARIABLE-SIZE AUXILIARY DRIVE AND CONTROL METHOD THEREOF

TECHNICAL FIELD

The present disclosure relates to the field of robotics, in particular to an underwater robot based on a variable-size auxiliary drive and a control method thereof.

BACKGROUND

With the continuous excavation of the depths of the ocean by humans, underwater survey robots are more and more widely used in water quality monitoring, submarine topographic survey, mineral survey, biota detection and other tasks. However, the underwater environment is often complex, which requires that the underwater detection robots must have sufficient cruising ability and anti-interference ability and also reduce the impact on the underwater ecological environment as much as possible. Traditional underwater robots are driven by relying on multiple pairs of screw propellers to provide power for horizontal and vertical directions respectively. When rotors in the vertical direction operate at different depths, they all need to keep operating to provide power or buoyancy for the robots, so more energy for controlling the ups and downs of the robots is consumed.

SUMMARY

In view of this, to solve the above technical problems, an objective of the present disclosure is to provide an underwater robot based on a variable-size auxiliary drive and a control method thereof. The energy consumption of the underwater robot is reduced.

An embodiment of the present disclosure adopts the following technical solution:

An underwater robot based on a variable-size auxiliary drive, including:

a variable-size auxiliary drive module, including a first variable-size silo, at least two first variable-size units and at least two first gasbags, where the first gasbags are fixed to an outer side of the first variable-size silo, the first variable-size silo has a first accommodating space with at least two first accommodating subspaces, each of the first variable-size units includes a first micro push rod motor, a first push rod, a first push plate and a first gas guide tube, the first micro push rod motor, the first push rod and the first push plate are accommodated in the corresponding first accommodating subspace, the first push rod is fixed to the first push plate, and one of the first gas guide tubes correspondingly communicates with one of the first accommodating subspaces and one of the first gasbags; and a main control system, electrically connected with the first micro push rod motors and configured to control the first micro push rod motors to drive the first push rods to drive the first push plates to extend and retract and to adjust the size of the first gasbags by the first gas guide tubes.

Further, the underwater robot based on the variable-size auxiliary drive includes the four first gasbags and the four first variable-size units, where the first accommodating space has the four first accommodating subspaces that are separated by partitions, each of the first accommodating subspaces is configured to accommodate one of the first variable-size units, the four first gasbags are arranged around the outer side of the first variable-size silo, and the first gasbags are fixed by fixing skeletons.

Further, the first variable-size silo includes a main body, a first seal cover and a second seal cover; and the main body includes the first accommodating space, the first seal cover is fixed to one end of the main body and provided with a plurality of first through holes, the second seal cover is fixed to the other end of the main body, each of the first seal cover and the second seal cover is provided with an embedded rabbet, the first through holes are arranged in correspondence to the first gas guide tubes, and the partitions are arranged in the embedded rabbets to separate the first accommodating subspaces independently.

Further, the first push plate is a sealing rubber push plate, and when the first push plate extends by a maximum distance, the corresponding first accommodating subspace and the corresponding first gasbag are sealed.

Further, the underwater robot based on the variable-size auxiliary drive further includes a propulsion module, where the propulsion module includes a steering rotor module including a steering rotor fixing frame, a first steering rotor and a second steering rotor, the steering rotor fixing frame is fixed to the variable-size auxiliary drive module and includes at least one hole for the first gas guide tubes to pass through, and the first steering rotor and the second steering rotor are symmetrically arranged on left and right sides of the steering rotor fixing frame; and the first steering rotor and the second steering rotor are connected with the main control system.

Further, the underwater robot based on the variable-size auxiliary drive further includes a head vision system, where the propulsion module further includes a tail propeller, the head vision system is arranged on a front side of the variable-size auxiliary drive module, the tail propeller is arranged on a rear side of the variable-size auxiliary drive module, and the head vision system includes a camera, a searchlight module and a sensor module that are connected with the main control system; and the main control system controls the brightness of the searchlight module according to the depth of the underwater robot based on the variable-size auxiliary drive in water and adjust the size of the first gasbags according to environmental data acquired by the camera and the sensor module to adjust an attitude.

An embodiment of the present disclosure further provides a control method, used in the underwater robot based on the variable-size auxiliary drive, and including:

acquiring real-time data, where the real-time data includes the environmental data and/or atmospheric pressure data, and the atmospheric pressure data includes an atmospheric pressure of each of the first gasbags; and controlling, by the main control system, the first micro push rod motors and the propulsion module according to the real-time data.

Further, controlling the first micro push rod motors and the propulsion module according to the real-time data comprises:

when the atmospheric pressure of one of the first gasbags changes abnormally, controlling the first micro push rod motor corresponding to the first gasbag to control the corresponding first push plate to extend by the maximum distance to seal the first gasbag and the first accommodating subspace corresponding to the first gasbag, adjusting the size of the remaining of the first gasbags to make the underwater robot face the water surface, and controlling the propulsion module to operate at a full speed;

or, when the environmental data includes a target object approaching the underwater robot, controlling the propulsion module to operate at a reduced speed, and controlling the first micro push rod motors to adjust the size of the first gasbags; and when the underwater robot is adjusted to face an open area, controlling the propulsion module to operate at an increased speed.

Further, the environmental data includes target image data; and the control method further includes:

when the depth in the water changes, adjusting the brightness of the searchlight module, wherein the brightness is directly proportional to the depth in the water; and acquiring original image data after the brightness is adjusted, and coloring and dehazing the original image data, so as to obtain the target image data.

Further, controlling the first micro push rod motors according to the real-time data comprises:

inputting the environmental data into a deep deterministic policy gradient model, so as to determine an optimal attitude of the underwater robot; and controlling the first micro push rod motors to adjust the underwater robot to the optimal attitude.

The present disclosure has the following technical effects: the variable-size auxiliary drive module and the main control system are arranged; the variable-size auxiliary drive module includes the first variable-size silo, the at least two first variable-size units and the at least two first gasbags; the first gasbags are fixed to the outer side of the first variable-size silo; the first variable-size silo has the first accommodating space with the at least two first accommodating subspaces; each of the first variable-size units includes the first micro push rod motor, the first push rod, the first push plate and the first gas guide tube; the first micro push rod motor, the first push rod and the first push plate are accommodated in the corresponding first accommodating subspace; the first push rod is fixed to the first push plate; one of the first gas guide tubes correspondingly communicates with one of the first accommodating subspaces and one of the first gasbags; and the main control system is electrically connected with the first micro push rod motors and configured to control the first micro push rod motors to drive the first push rods to drive the first push plates to extend and retract and to adjust the size of the first gasbags by the first gas guide tubes. By changing the size of the first gasbags, buoyancy may be provided for the underwater robot, thereby reducing the energy consumption for controlling the ups and downs of the underwater robot.

DETAILED DESCRIPTION OF EMBODIMENTS

To make those skilled in the art better understand the solutions of the present application, the technical solutions in the embodiments of the present disclosure are clearly and completely described below with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

The terms "first", "second", "third" and "fourth" in the description, claims and accompanying drawings of the present application are used to distinguish different objects, rather than to describe a specific sequence. Furthermore, the terms "include", "have" and any variation thereof are intended to cover non-exclusive inclusion. For example, processes, methods, systems, products or devices including a series of steps or units are not limited to listed steps or units, but optionally also include unlisted steps or units, or optionally also include other steps or units inherent to these processes, methods, products or devices.

Reference herein to the "embodiments" means that specific features, structures or characteristics described with reference to the embodiments may be included in at least one embodiment of the present application. The appearances of the phrase at various positions in the description are not necessarily all referring to the same embodiment, nor separate or alternative embodiments that are mutually exclusive of other embodiments. It is explicitly and implicitly understood by those skilled in the art that the embodiments described herein may be combined with other embodiments.

In the embodiments of the present disclosure, Y represents a front-rear direction (longitudinal direction), Z represents a left-right direction (horizontal direction), and X represents an up-down direction (vertical direction).

Figure 1:
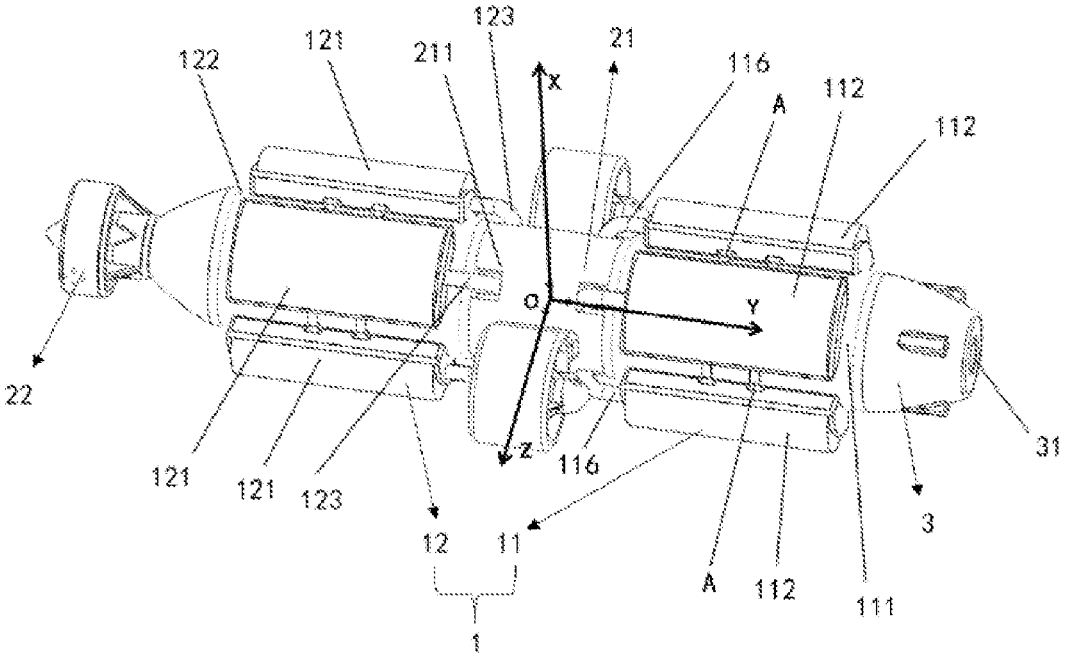
FIG. 1 is a schematic diagram of an underwater robot based on a variable-size auxiliary drive according to a specific embodiment of the present disclosure.

As shown in FIG. 1, an embodiment of the present disclosure provides an underwater robot based on a variable-size auxiliary drive, including a variable-size auxiliary drive module 1, a main control system (not shown), a propulsion module (including a steering rotor module 21 and a tail propeller 22) and a head vision system 3.

Figure 2:
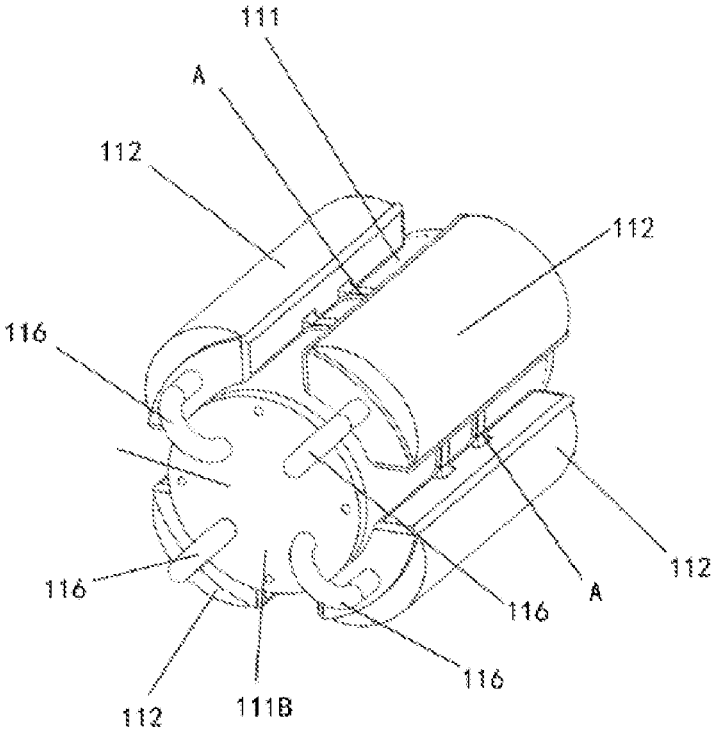
FIG. 2 is a schematic diagram of a first variable-size auxiliary drive submodule according to a specific embodiment of the present disclosure.
Figure 3:
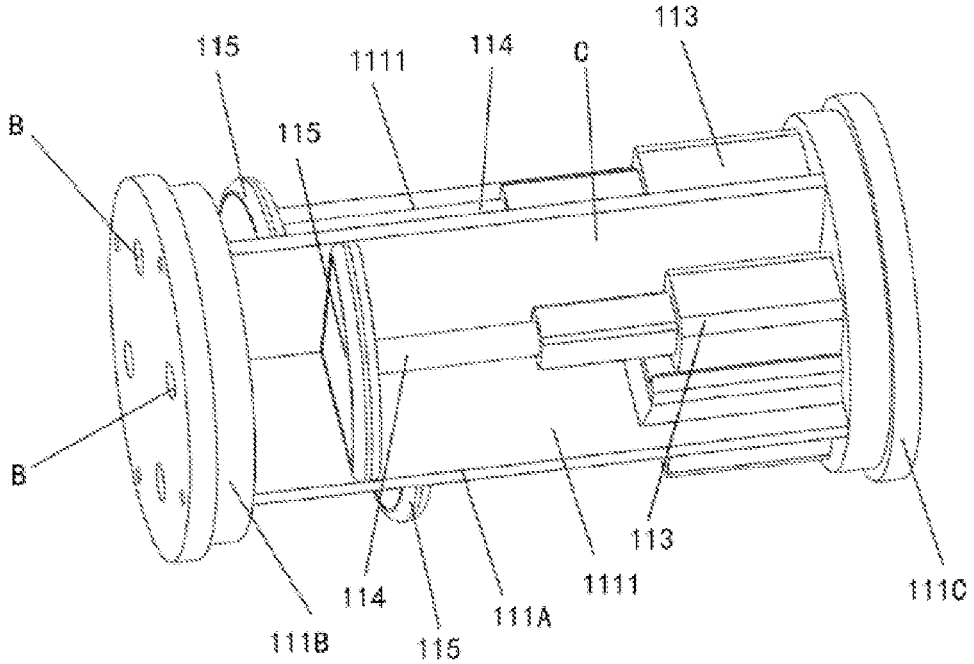
FIG. 3 is a schematic diagram of an interior of a first variable-size silo according to a specific embodiment of the present disclosure.

As shown in FIG. 1, FIG. 2 and FIG. 3, in the embodiment of the present disclosure, the variable-size auxiliary drive module 1 includes a first variable-size auxiliary drive submodule 11, and the first variable-size auxiliary drive submodule 11 includes a first variable-size silo 111, at least two first variable-size units and at least two first gasbags 112. Optionally, the variable-size auxiliary drive module 1 is described by taking as an example that it includes four first variable-size units and four first gasbags 112. Specifically, the first gasbags 112 are fixed to an outer side of the first variable-size silo 111, the four first gasbags 112 are arranged around the outer side of the first variable-size silo 111, for example, the four first gasbags 112 are respectively arranged on an upper left side, a lower left side, an upper right side and a lower right side of the first variable-size silo 111, and the every two first gasbags 112 are fixed by fixing skeletons A. The first variable-size silo 111 has a first accommodating space with at least two first accommodating subspaces 1111, specifically four first accommodating subspaces 1111, each of the first accommodating subspaces 1111 is configured to accommodate one of the first variable-size units (at least a part), each of the first variable-size units includes a first micro push rod motor 113, a first push rod 114, a first push plate 115 and a first gas guide tube 116, the first micro push rod motor 113, the first push rod 114 and the first push plate 115 are accommodated in the corresponding first accommodating subspace 1111, the first push rod 114 is fixed to the first push plate 115, and one of the first gas guide tubes 116 correspondingly communicates with one of the first accommodating subspaces 1111 and one of the first gasbags 112, that is, one of the first gasbags 112 communicates with one of the first accommodating subspaces 1111 by one of the first gas guide tubes 116.

As shown in FIG. 1, FIG. 2 and FIG. 3, in the embodiment of the present disclosure, the first variable-size silo 111 includes a main body 111A, a first seal cover 111B and a second seal cover 111C. Optionally, the main body 111A includes the first accommodating space, the first seal cover 111B is fixed to one end of the main body 111A, and the second seal cover 111C is fixed to the other end of the main body 111A. The first seal cover 111B is provided with a plurality of first through holes B, each of the first seal cover 111B and the second seal cover 111C is provided with an embedded rabbet (not shown), and the first through holes B are formed in correspondence to the first gas guide tubes 116, that is, each of the first gas guide tubes 116 corresponds to one of the first through holes B and is configured to communicate with the corresponding first accommodating subspace 1111; a partition C is arranged in the embedded rabbet, specifically, one end of the partition C is fixed to the embedded rabbet of the first seal cover 111B, the other end of the partition C is fixed to the embedded rabbet of the second seal cover 111C, and the partition C is configured to separate each of the first accommodating subspaces 1111 independently, that is, the every two first accommodating subspaces 1111 are separated by the partition C to be not connected independently. Optionally, the first push plate 115 is a sealing rubber push plate, and when the first push plate 115 extends by a maximum distance, the corresponding first accommodating subspace 1111 and the corresponding first gasbag 112 are sealed, specifically: when the first push plate 115 extends by the maximum distance, the first push plate 115 is in contact with the first seal cover 111B, and the first push plate 115 seals the first through holes B in a coverage manner, so that the corresponding first accommodating subspace 1111 may not communicate with the corresponding first gasbag 112 through the corresponding first gas guide tube 116, and the corresponding first accommodating subspace 1111 and the corresponding first gasbag 112 are sealed.

Figure 4:
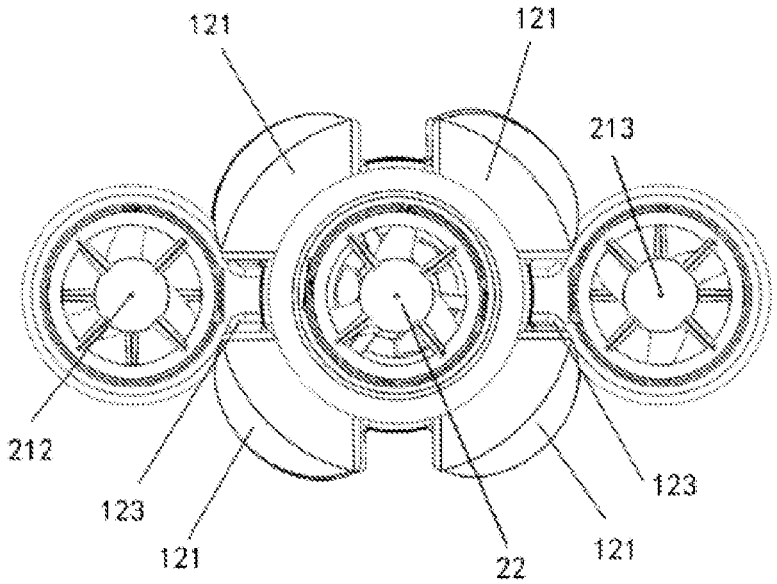
FIG. 4 is a schematic diagram of a propulsion module according to a specific embodiment of the present disclosure.

As shown in FIG. 1 and FIG. 4, in the embodiment of the present disclosure, the propulsion module includes a steering rotor module 21 and a tail propeller 22. Optionally, the steering rotor module 21 includes a steering rotor fixing frame 211, a first steering rotor 212 and a second steering rotor 213; and the power of the first steering rotor 212 and the power of the second steering rotor 213 are lower than the power of the tail propeller 22. The steering rotor fixing frame 211 is fixed to the variable-size auxiliary drive module 1, the steering rotor fixing frame 211 includes at least one hole, the number of which is adaptively set according to the number of the first gas guide tubes 116, and one of the holes is configured to allow one of the first gas guide tubes 116 to pass through. The first steering rotor 212 and the second steering rotor 213 are symmetrically arranged on left and right sides of the steering rotor fixing frame 211, and the first steering rotor 212, the second steering rotor 213 and the tail propeller 22 are connected to the main control system. Optionally, the first variable-size auxiliary drive submodule 11 is fixed to a front or rear side of the steering rotor fixing frame 211. In the embodiment of the present disclosure, the first variable-size auxiliary drive submodule is described by taking as an example that the first variable-size auxiliary drive submodule 11 is fixed to the front side of the steering rotor fixing frame 211.

As shown in FIG. 1 and FIG. 4, optionally, the variable-size auxiliary drive module 1 further includes a second variable-size auxiliary drive submodule 12 which is fixed to the rear side of the steering rotor fixing frame 211, and the second variable-size auxiliary drive submodule 12 similar to the first variable-size auxiliary drive submodule 11 in structure is described by taking as an example that it includes four second variable-size units and four second gasbags 121. Specifically, the second gasbags 121 are fixed to an outer side of a second variable-size silo 122, the four second gasbags 121 are arranged around the outer side of the second variable-size silo 122, for example, the four second gasbags 121 are respectively arranged on an upper left side, a lower left side, an upper right side and a lower right side of the second variable-size silo 122, and the every two second gasbags 121 are fixed by fixing skeletons. The second variable-size silo 122 has a second accommodating space (not shown) with four second accommodating subspaces (not shown), each of the second accommodating subspaces is configured to accommodate one of the second variable-size units (at least a part), each of the second variable-size units includes a second micro push rod motor (not shown), a second push rod (not shown), a second push plate (not shown) and a second gas guide tube 123, the second micro push rod motor, the second push rod and the first second plate are accommodated in the corresponding second accommodating subspace, the second push rod is fixed to the second push plate, and one of the second gas guide tubes 123 correspondingly communicates with one of the second accommodating subspaces and one of the second gasbags 121, that is, one of the second gasbags 121 communicates with one of the second accommodating subspaces by one of the second gas guide tubes 123. Likewise, the second variable-size silo 122 has a similar structure, the every two second accommodating subspaces are separated, the size of the second gasbags 121 is changed by extension and retraction of the second push rods, and each of the second micro push rod motors is connected with the main control system. In the embodiment of the present disclosure, the addition of the second variable-size auxiliary drive submodule 12 may further increase the buoyancy of the underwater robot and improve the diversity, precision and accuracy of attitude control of the underwater robot. Optionally, the number of the holes is also adaptively set according to the total number of the first gas guide tubes 116 and the second gas guide tubes 123, and one of the holes is configured to allow one of the first gas guide tubes 116 or the second gas guide tubes 123 to pass through. Optionally, both the first micro push rod motor 113 and the second micro push rod motor may be fastened and fixed by bolts.

As shown in FIG. 1, in the embodiment of the present disclosure, the head vision system 3 is arranged on a front side of the variable-size auxiliary drive module 1, and the tail propeller 22 is arranged on a rear side of the variable-size auxiliary drive module 1. Optionally, the head vision system 3 is arranged on a front side of the first variable-size auxiliary drive submodule 11 and fixed to the first variable-size auxiliary drive submodule 11, and the tail propeller 22 is arranged on a rear side of the second variable-size auxiliary drive submodule 12 and fixed to the second variable-size auxiliary drive submodule 12. In other embodiments, the head vision system 3 may be arranged on the rear side of the second variable-size auxiliary drive submodule 12, and the tail propeller 22 may be arranged on the front side of the first auxiliary drive submodule 11.

As shown in FIG. 1, optionally, the head vision system 3 includes a camera 31, a searchlight module (not shown) and a sensor module (not shown), and the camera 31, the searchlight module and the sensor module are connected with the main control system. Optionally, the searchlight module is an adjustable high-brightness searchlight array, the camera 31 is a binocular camera, and the searchlight module and the camera 31 may be used for underwater object finding, underwater building damage diagnosis and other tasks by cooperation.

In the embodiment of the present disclosure, the main control system is electrically connected with the first micro push rod motors 113 and the second micro push rod motors and configured to control the first micro push rod motors 113 to drive the first push rods 114 to drive the first push plates 115 to extend and retract and to adjust the size of the first gasbags 112 by the first gas guide tubes 116. Specifically, when the first micro push rod motors 113 are controlled to drive the first push rods 114 to extend, air in the first accommodating subspaces 1111 may be delivered to the first gasbags 112 by the first gas guide tubes 116, so as to increase the size of the first gasbags 112; and in contrast, when the first micro push rod motors 113 are controlled to drive the first push rods 114 to retract, the air in the first gasbags 112 may be delivered to the first accommodating subspaces 1111 by the first gas guide tubes 116, so as to reduce the size of the first gasbags 112. It should be noted that the second micro push rod motors and the second push plates have a same control principle, that will not be repeated here. It should be noted that the size of the first gasbags 112 may provide the buoyancy for the underwater robot, and by adopting different size adjustment policies for the four first gasbags 112, the buoyancy of the underwater robot in different directions may be controlled, thereby controlling an attitude of the underwater robot; and on this basis, the size of the second gasbags 121 may be further combined to provide stronger buoyancy for the underwater robot, and by a size adjustment policy of adding the four second gasbags 121 in a total of the eight gasbags, the diversity of controlling the buoyancy of the underwater robot in the different directions may be enriched, thereby controlling the attitude of the underwater robot in a more diverse and refined manner.

In the embodiment of the present disclosure, the main control system is further configured to control the brightness of the searchlight module according to the depth of the underwater robot based on the variable-size auxiliary drive in water and to adjust the size of the first gasbags 112 and the second gasbags 121 according to environmental data acquired by the camera 31 and the sensor module so as to adjust the attitude. Optionally, the sensor module includes but is not limited to a depth sensor, an inertial measurement unit (IMU), a temperature sensor, etc., the depth sensor is configured to acquire the depth (the depth in the water) of the underwater robot in the water, and the camera 31 is configured to acquire image data around the underwater robot. It should be noted that the environmental data includes but is not limited to data acquired by the camera 31 and the sensor module.

In the embodiment of the present disclosure, the variable-size auxiliary drive module 1 further includes an atmospheric pressure unit, and the atmospheric pressure unit includes a plurality of first pressure sensors and a plurality of second pressure sensors, where each of the first pressure sensors is arranged on an inner wall of the corresponding first gasbag 112 and configured to acquire a first atmospheric pressure of each of the first gasbag 112, and each of the second pressure sensors is arranged on an inner wall of the corresponding second gasbag 121 and configured to acquire a second atmospheric pressure of each of the second gasbags 121.

Figure 5:
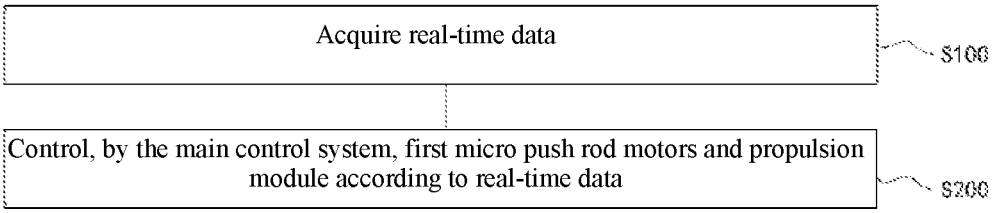
FIG. 5 is a flowchart of steps of a control method according to a specific embodiment of the present disclosure.

As shown in FIG. 5, an embodiment of the present disclosure provides a control method, which may be used in the underwater robot based on the variable-size auxiliary drive, including the steps S100-S200:

S100: real-time data is acquired.

In the embodiment of the present disclosure, the real-time data includes the environmental data and/or atmospheric pressure data. It should be noted that the atmospheric pressure data may include an atmospheric pressure, specifically a first atmospheric pressure, of each of the first gasbags, and an atmospheric pressure, specifically a second atmospheric pressure, of each of the second gasbags; and the environmental data includes but is not limited to the data acquired by the camera and the sensor module.

S200: the main control system controls the first micro push rod motors and the propulsion module according to the real-time data.

It may be understood that when the variable-size auxiliary drive module includes the second variable-size auxiliary drive submodule, the main control system may control the first micro push rod motors, the second micro push rod motors and the propulsion module according to the real-time data. It should be noted that in the embodiment of the present application, the first micro push rod motors and the first gasbags have the same control principle as the second micro push rod motors and the second gasbags, so the control principle of the first micro push rod motors and the first gasbags are taken as an example for description, but it does not represent that the control method in the embodiment of the present disclosure does not include the control on the second micro push rod motors and the second gasbags.

Optionally, the step S200 includes the step S210 or S220:

S210: when the atmospheric pressure of one of the first gasbags changes abnormally, the first micro push rod motor corresponding to the first gasbag is controlled to control the corresponding first push plate to extend by the maximum distance to seal the first gasbag and the first accommodating subspace corresponding to the first gasbag, the size of the remaining of the first gasbags is adjusted to make the underwater robot face the water surface, and the propulsion module is controlled to operate at a full speed.

Figure 6:
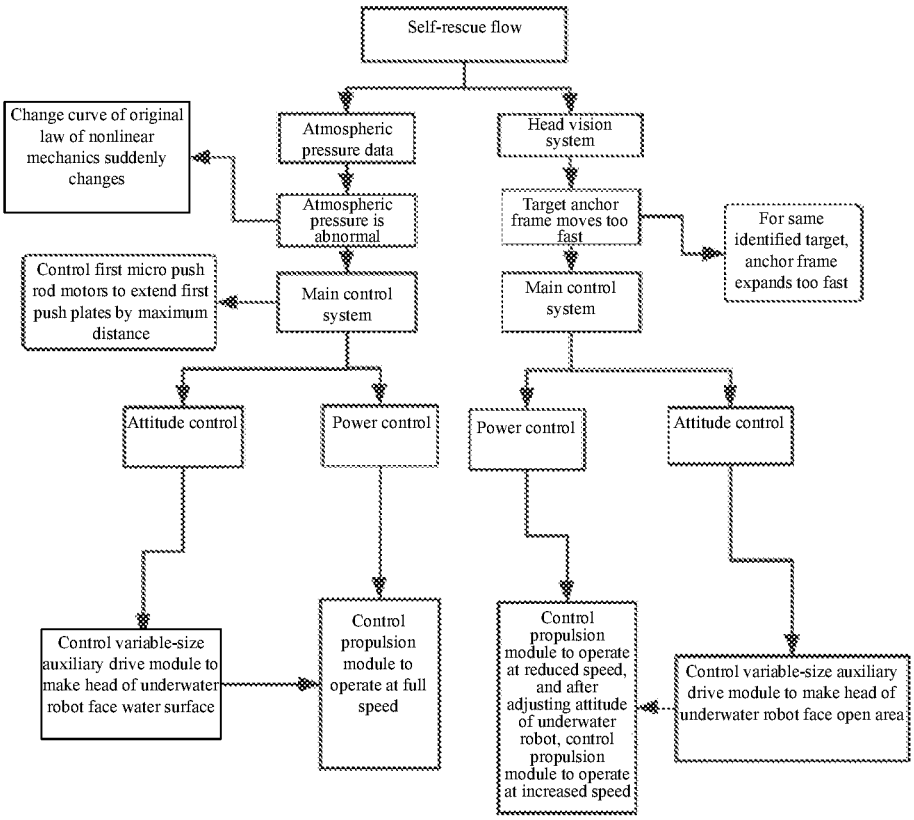
FIG. 6 is a flowchart of a self-rescue process according to an embodiment of the present disclosure.

As shown in FIG. 6, in the embodiment of the present disclosure, when the atmospheric pressure of any one of the first gasbags changes abnormally, such as rupture occurs, the water will enter the first gasbag, the main control system controls the corresponding first micro push rod motor to rotate to extend the corresponding first push plate by the maximum distance, and at this time, the corresponding first push plate is in contact with the first seal cover and seals the first through holes in a coverage manner, so that the corresponding first accommodating subspace may not communicate with the corresponding first gasbag by the corresponding first gas guide tube, the corresponding first accommodating subspace and the corresponding first gasbag are sealed, that is, the corresponding first gasbag and the first accommodating subspace corresponding to the first gasbag are sealed, and the damage to the corresponding first variable-size unit due to the fact that the water flows back into the corresponding first accommodating subspace is not caused even if the corresponding first gasbag is ruptured. Then, the size of the remaining three first gasbags is adjusted to make the head vision system or the steering rotor module of the underwater robot face the water surface, and the propulsion module is controlled to operate at a full speed, such as the first steering rotor, the second steering rotor and the tail propeller are controlled to operate at full power; and transverse power is provided by the first steering rotor and the second steering rotor and longitudinal power is provided by the tail propeller, so that the underwater robot may accelerate to escape from the water surface to ensure the safety of the underwater robot and timely repair the ruptured first gasbag. Optionally, it may be determined whether the atmospheric pressure of each of the first gasbags changes abnormally according to whether a change curve of an original law of nonlinear mechanics suddenly changes.

Optionally, when the main control system controls the first micro push rod motors according to the real-time data, the environmental data may be input into a deep deterministic policy gradient model, the deep deterministic policy gradient model may be used to make an analysis and output the optimal attitude of the underwater robot, and then the main control system controls the first micro push rod motors (and/or the second micro push rod motors) to adjust the underwater robot to the optimal attitude. For example, when the head vision system or the steering rotor module of the underwater robot faces the water surface, the underwater robot has multiple possible attitudes, and the optimal attitude may make the underwater robot more stable, the distance of escaping from the water surface shorter or the time to escape the water surface shortest, thereby further improving the efficiency of the underwater robot leaving the water surface and enhancing the safety.

For example, when there is an optimal moment M' in the optimal attitude, for example, by taking the first gasbags located on the upper right side and the lower right side of the first variable-size silo as an example, the buoyancy F1 and the buoyancy F3 are respectively generated and respectively projected to be tangent to the shape (such as a circle) of one end of the main body of the first variable-size silo and the directions of connection lines between points where the two buoyancies are located and the center of the circle, the angles between the directions of the two buoyancies and the connection lines between the points where the two buoyancies are located and the center of the circle are set to be $\theta$ and $\beta$, the distances from the two buoyancies to the center of the circle are both R, and then there is an actual moment $M=(F1*SIN\ \theta-F3*COS\ \beta)*R$, so the main control system may adjust parameters in the actual moment M by adjusting the size of the first gasbags to adjust the actual moment M, and the actual torque M is adjusted to the optimal torque M'. A relationship between the size of each of the first gasbags and the buoyancy is as follows: $\Delta F=\rho*g*\Delta V$, where $\Delta F$ is the buoyancy changed within unit time, $\rho$ is the density of a liquid in which it is located, g is a gravitational acceleration in an area, and $\Delta V$ is the size of the first gasbag changed within unit time.

It should be noted that the deep deterministic policy gradient model may be determined based on training by reinforcement learning or a deep deterministic policy gradient (DDPG) algorithm. For example, reading may read and acquire the data or continuous information such as an action set of the underwater robot, and such continuous information may be acquired by robotic physical simulation platforms such as ROS and GYM; after the model is parameterized, nondiscrete continuous information such as states and actions is converted into corresponding state values and action values, where different state values correspond to the attitudes of the underwater robot presented by expansion of the first gasbags (or including the second gasbags) at different parts to various degrees without the involution of the first steering rotor and the second steering rotor, and the action values correspond to the distances, increased or reduced by the first micro push rod motors, of the first push rods; a motion device probably selects a motion policy in a continuous motion set, the state values and the action values are input into a judgment device, estimated values are acquired by training a Q network and compared with target estimated values, a loss function is imported to calculate parameters, the acquired parameters will be input into optimizers of an action device and the judgment device respectively, the weight of the network is updated, and a state value of an action policy selected by the action device at a next moment is updated; and it is worth noting that when a decision is made each time, a Q function Q(st, a, r, st+1), in which the Q function is an evaluation function, st is the state value at this moment, a is the action value at this moment, r is a total reward value at this moment, and st+1 is the state value at the next moment, will be stored in an experience pool, and the experience pool will perform partial sample playback, that is, probably selects a Q value at each moment, and the parameters of the action device and the judgment device are updated to determine the optimal action (attitude) according to the total reward value.

For example, the underwater robot may have a first attitude, such as one of the attitudes adopted by accelerated diving, there are different methods to obtain the attitude based on control information extracted by the action device in the intelligent control algorithm (deep deterministic policy gradient algorithm), the essence is to generate a clockwise moment on an XOY surface to make the head face an obliquely downward side of the water surface, a machine body will execute the "optimal attitude" selected probably by the intelligent control algorithm, and the selection of the "optimal attitude" depends on model training parameters of reinforcement learning, that is, when the adjustment of the attitude is completed, the first micro push rod motors change the buoyancy by the distance selected by the intelligent control algorithm, so as to obtain the optimal torque M' required for steering; and a second attitude is an attitude policy adopted by the machine body facing a vertical narrow environment, a third one is an attitude policy adopted when facing a horizontal narrow environment, and methods, the same as above, to achieve the two attitudes depend on the "optimal attitude" selected by the intelligent attitude control algorithm, where a specific algorithm flow is as follows: the head vision system acquires image data of a terrain ahead, the head vision system or the main control system performs rectangular segmentation of a light color gamut of the image data, a generated maximum rectangular anchor frame is namely a space that may accommodate the machine body to pass, and the main control system decides a best passing attitude, executes the "optimal attitude", gradually reduces an attitude difference, and adjusts the attitude to a decision-making attitude; and by this narrow environment, it can be understood that the attitudes of the underwater robot are not limited to the above attitudes.

S220: when the environmental data includes a target object approaching the underwater robot, the propulsion module is controlled to operate at a reduced speed, and the first micro push rod motors are controlled to adjust the size of the first gasbags; and when the underwater robot is adjusted to face an open area, the propulsion module is controlled to operate at an increased speed.

As shown in FIG. 6, in the embodiment of the present disclosure, when the target object approaching the underwater robot, including but not limited to fishes or foreign objects moving at a high speed, included in the image data acquired by the camera moves toward the underwater robot (for example, the image data is identified to determine a target anchor frame, and the target anchor frame moves too fast or the anchor frame expands too fast for a same identified target), the main control system controls the propulsion module, including but not limited to the first steering rotor, the second steering rotor and the tail propeller, to operate at a reduced speed, so as to avoid collision with the target object, and then controls the first micro push rod motors to adjust the size of the first gasbags to adjust the attitude of the underwater robot; the image data is analyzed to determine the open area (that is, a light-colored area/open water area/area without the target object in the image data); and the head vision system of the underwater robot faces the open area, and the propulsion module is controlled to operate at an increased speed, such as at least one of the first steering rotor, the second steering rotor and the tail propeller is controlled to operate at an increased or full speed, so as to avoid the target object and realize self rescue.

Optionally, the control method in the embodiment of the present disclosure further includes the steps S310-S320, where the steps S310-S320 and the steps S100 and S200 do not limit an execution sequence, specifically:

S310: when the depth in the water changes, the brightness of the searchlight module is adjusted.

Specifically, when the depth in the water changes, the main control system adjusts the brightness of the searchlight module, where the brightness is directly proportional to the depth in the water, and the larger the depth in the water is, the higher the brightness is, otherwise, the lower the brightness is. In the embodiment of the present disclosure, by adjusting the brightness of the searchlight module, the illumination lost by Rayleigh scattering of water molecules and impurities in the water may be supplemented, thereby reducing the influence of underwater light scattering faced by deep underwater image data or video data, and making the data acquired by the camera clearer.

S320: original image data is acquired after the brightness is adjusted, and the original image data is colored and dehazed, so as to obtain target image data.

Specifically, after the brightness is adjusted, the camera acquires the original image data by shooting, and the main control system colors the original image data by adversarial nerves, repairs the saturation of the original image data, and then further processes the original image data by a dehazing algorithm to improve the image quality of the target image data. It should be noted that the target image data, as a part of the environmental data, is used for the main control system to make a judgment, including but not limited to the identification and judgment of the target object, on the condition according to the target image data, so as to improve the identification accuracy of the target object.

In conclusion, the underwater robot based on the variable-size auxiliary drive according to the embodiment of the present disclosure is small in size and light in weight, which reduces the energy consumption of the underwater robot. Underwater whole lifting may be controlled by the variable-size auxiliary drive module, and a pitch angle and a sideslip angle are subjected to attitude adjustment by the variable-size auxiliary drive module. Compared with a traditional underwater survey robot, the underwater robot based on the variable-size auxiliary drive is more energy-saving, has flexible attitudes and may be subjected to more complex attitude control; the control of the main control system may reduce the dependence of the attitude control or correction on manual work, and the searchlight module of the head vision system may overcome the underwater light scattering often encountered in underwater survey tasks and may effectively extract environmental features and transmit information to the main control system; and in an emergency, for example, when the gasbags are ruptured or there is the target object, the main control system effectively helps itself to get out of danger.

An embodiment of the present disclosure further provides an electronic device, including a processor and a memory, where the memory stores at least one instruction, at least one program, and a code set or instruction set therein, that are loaded and executed by the processor to implement the control method of the foregoing embodiment. The electronic device in the embodiment of the present disclosure includes, but is not limited to, any intelligent terminal such as a mobile phone, a tablet computer, a computer, and a vehicle-mounted computer.

The contents in the embodiment of the above method are all applicable to the embodiment of this device, and the embodiment of this device has the same specific functions and achieved beneficial effects as the embodiment of the above method.

An embodiment of the present disclosure further provides a computer-readable storage medium, storing at least one instruction, at least one program, and a code set or instruction set therein, that are loaded and executed by the processor to implement the control method of the foregoing embodiment.

Embodiments of the present disclosure further provide a computer program product or computer program, including computer instructions, that are stored in the computer-readable storage medium. The processor of the computer device reads the computer instructions from the computer-readable storage medium, and executes the computer instructions, thereby making the computer device execute the control method of the foregoing embodiment.

The terms "first", "second", "third", and "fourth" (if they exist) in the description and accompanying drawings of the present application are used to distinguish similar objects, rather than to describe a specific sequence or sequence. It is to be understood that the data used in this way may be interchanged under appropriate circumstances, so that the embodiment of the application described herein may be implemented in sequences other than those illustrated or described herein. Furthermore, the terms "include", "have" and any variation thereof are intended to cover non-exclusive inclusion. For example, processes, methods, systems, products or devices including a series of steps or units are not necessarily limited to clearly listed steps or units, but may include unclearly unlisted steps or units, or other steps or units inherent to these processes, methods, products or devices.

It should be understood that, in this application, "at least one (item)" refers to one or more, and "a plurality of" refers to two or more. "And/or" is used to describe an association relationship between associated objects, and it indicates that there may be three kinds of relationships. For example, "A and/or B" may indicate that: only A, only B, and both A and B exist, where A and B may be singular or plural. The character "/" generally indicates that the contextual associated objects are an "or" relationship. "At least one item (piece) below" or similar expressions thereof refer to any combination of these items, including any combination of singular item (piece) or plural items (piece). For example, at least one item (piece) of a, b and c, may represent: a, b, c, "a and b", "a and c", "b and c", or "a, b and c", where a, b, c may be one or more.

In the several embodiments provided in this application, it should be understood that the disclosed device and method may be implemented in other ways. For example, the embodiment of the device described above is merely illustrative. For example, the division of units is merely a logical function division. In actual implementation, there may be other division ways. For example, multiple units or components may be combined or integrated to another system, or some features may be ignored or not implemented. According to another point, shown or discussed mutual coupling or direct coupling or communication connection may be indirect coupling or communication connection of devices or units through some interfaces, and may be in electrical, mechanical or other forms. Units described as separate components may or may not be physically separated, and components shown as units may or may not be physical units, that is, may be located in one place, or may be distributed to multiple network units. Some or all of the units may be selected according to actual needs to achieve the objective of the solution in this embodiment. In addition, each functional unit in each embodiment of the present application may be integrated into one processing unit, each unit may exist physically alone, or two or more units may be integrated into one unit. The above integrated unit may be implemented in the form of hardware or a software functional unit.

The integrated unit, if implemented in the form of the software functional unit and sold or used as a stand-alone product, may be stored in one computer-readable storage medium. Based on such understanding, the technical solution of the present application essentially, a part that contributes to the prior art, or all or part of the technical solution may be embodied in the form of a software product, and the computer software product is stored in one storage medium and includes multiple instructions for making one computer device (which may be a personal computer, a server, or a network device) execute all or part of the steps of the method in each embodiment of the present application. The foregoing storage medium includes: a U disk, a mobile hard disk, a read-only memory (ROM for short), a random access memory (RAM for short), a magnetic disk or a compact disc that may store programs.

The above embodiments are merely used to describe the technical solution of the present disclosure, but not to limit it; although the present disclosure has been described in detail with reference to the above embodiments, those of ordinary skill in the art should understand that: they still may modify the technical solution described in the above embodiments, or equivalently replace part or all of technical features in the technical solution; and these modifications or replacements do not make the essence of the corresponding technical solution depart from the spirit and scope of the technical solution of each embodiment of the present disclosure.

What is claimed is:

1. An underwater robot based on a variable-size auxiliary drive, comprising:

a variable-size auxiliary drive module, comprising a first variable-size silo, at least two first variable-size units and at least two first gasbags, wherein the first gasbags are fixed to an outer side of the first variable-size silo, the first variable-size silo has a first accommodating space with at least two first accommodating subspaces, each of the first variable-size units comprises a first push rod motor, a first push rod, a first push plate and a first gas guide tube, the first push rod motor, the first push rod and the first push plate are accommodated in the corresponding first accommodating subspace, the first push rod is fixed to the first push plate, and one of the first gas guide tubes correspondingly communicates with one of the first accommodating subspaces and one of the first gasbags; and a main control system, electrically connected with the first push rod motors and configured to control the first push rod motors to drive the first push rods to drive the first push plates to extend and retract and to adjust the size of the first gasbags by the first gas guide tubes.

2. The underwater robot based on a variable-size auxiliary drive according to claim 1, wherein the underwater robot based on the variable-size auxiliary drive comprises four first gasbags and four first variable-size units, the first accommodating space has four first accommodating subspaces that are separated by partitions, each of the first accommodating subspaces is configured to accommodate one of the first variable-size units, the four first gasbags are arranged around the outer side of the first variable-size silo, and the first gasbags are fixed by fixing skeletons.

3. The underwater robot based on a variable-size auxiliary drive according to claim 2, wherein the first variable-size silo comprises a main body, a first seal cover and a second seal cover; and the main body comprises the first accommodating space, the first seal cover is fixed to one end of the main body and provided with a plurality of first through holes, the second seal cover is fixed to the other end of the main body, each of the first seal cover and the second seal cover is provided with an embedded rabbet, the first through holes are arranged in correspondence to the first gas guide tubes, and the partitions are arranged in the embedded rabbets to separate the first accommodating subspaces independently.

4. The underwater robot based on a variable-size auxiliary drive according to claim 1, wherein the first push plate is a sealing rubber push plate, and when the first push plate extends by a maximum distance, the corresponding first accommodating subspace and the corresponding first gasbag are sealed.

5. The underwater robot based on a variable-size auxiliary drive according to claim 1, further comprising a propulsion module, wherein the propulsion module comprises a steering rotor module comprising a steering rotor fixing frame, a first steering rotor and a second steering rotor, the steering rotor fixing frame is fixed to the variable-size auxiliary drive module and comprises at least one hole for the first gas guide tubes to pass through, and the first steering rotor and the second steering rotor are symmetrically arranged on left and right sides of the steering rotor fixing frame; and the first steering rotor and the second steering rotor are connected with the main control system.

6. The underwater robot based on a variable-size auxiliary drive according to claim 5, further comprising a head vision system, wherein the propulsion module further comprises a tail propeller, the head vision system is arranged on a front side of the variable-size auxiliary drive module, the tail propeller is arranged on a rear side of the variable-size auxiliary drive module, and the head vision system comprises a camera, a searchlight module and a sensor module that are connected with the main control system; and the main control system controls the brightness of the searchlight module according to the depth of the underwater robot based on the variable-size auxiliary drive in water and adjust the size of the first gasbags according to environmental data acquired by the camera and the sensor module to adjust an attitude.

* * * * *